US008567773B2

(12) United States Patent
Berendes

(10) Patent No.: US 8,567,773 B2
(45) Date of Patent: Oct. 29, 2013

(54) DEVICE FOR HANDLING BANKNOTES

(75) Inventor: Elmar Berendes, Warburg (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/515,875

(22) PCT Filed: Dec. 16, 2010

(86) PCT No.: PCT/EP2010/069871
§ 371 (c)(1),
(2), (4) Date: Jun. 14, 2012

(87) PCT Pub. No.: WO2011/083014
PCT Pub. Date: Jul. 14, 2011

(65) Prior Publication Data

US 2012/0261876 A1 Oct. 18, 2012

(30) Foreign Application Priority Data

Dec. 16, 2009 (DE) ..... 10 2009 058 519

(51) Int. Cl.
*B65H 85/00* (2006.01)

(52) U.S. Cl.
USPC ..... 271/3.01; 271/3.12; 271/149; 235/379

(58) Field of Classification Search
USPC ..... 271/3.01, 3.12, 149; 235/379
See application file for complete search history.

(56) References Cited

U.S. PATENT DOCUMENTS 4,753,431 A * 6/1988 Fujimoto et al. ..... 271/3.08
5,271,613 A * 12/1993 Hain ..... 271/3.12
6,889,897 B2 * 5/2005 Nomiyama et al. ..... 235/379
7,950,653 B2 5/2011 Berendes
2005/0284925 A1 12/2005 Ahn et al.
2008/0001352 A1 1/2008 Jeong
2008/0006564 A1 1/2008 Jeong (Continued)

FOREIGN PATENT DOCUMENTS

DE 102008018935 A1 10/2009
JP 58150179 U 10/1983
JP 2005010961 A 1/2005

OTHER PUBLICATIONS

International Search Report (in German and English) and Written Opinion (in German) for PCT/EP2010/069871, mailed Oct. 5, 2011; ISA/EP.

(Continued)

*Primary Examiner* — Kaitlin Joerger

(74) *Attorney, Agent, or Firm* — Harness, Dickey & Pierce, P.L.C.

(57) ABSTRACT

The invention relates to a device for handling notes of value, comprising at least one cash box for receiving notes of value and at least one separating and/or stacking module for removing notes of value and/or for supplying notes of value to the cash box. Here, the separating and/or stacking module and the cash box are arranged separately from each other. The cash box comprises a retraction element which in a swiveled-away position is arranged such that the notes of value are suppliable to the cash box by means of the separating and/or stacking module through an opening of the cash box and/or are removable from the cash box. In a retaining position, the retraction element is arranged such that no notes of value are suppliable to and no notes of value are removable from the cash box.

12 Claims, 12 Drawing Sheets

(56) References Cited

U.S. PATENT DOCUMENTS

| | | | |
|---|---|---|---|
| 2011/0031308 | A1 | 2/2011 | Holland-Letz et al. |
| 2011/0065302 | A1 | 3/2011 | Berendes |
| 2011/0101013 | A1 | 5/2011 | Berendes |
| 2011/0155736 | A1 | 6/2011 | Berendes |

OTHER PUBLICATIONS

International Preliminary Report on Patentability for PCT/EP2010/069871 with English translation (Jul. 12, 2012).

* cited by examiner

DEVICE FOR HANDLING BANKNOTES

CROSS-REFERENCE TO RELATED APPLICATIONS

This application is a National Stage of International Application No. PCT/EP2010/069871, filed Dec. 16, 2010, and published in German as WO 2011/083014 A2 on Jul. 14, 2011. This application claims the benefit and priority of German Application No. 10 2009 058 519.2, filed Dec. 16, 2009. The entire disclosures of the above applications are incorporated herein by reference.

BACKGROUND

This section provides background information related to the present disclosure which is not necessarily prior art.

TECHNICAL FIELD

The invention relates to device for handling notes of value, comprising at least one cash box for receiving notes of value and at least one separating and/or stacking module for removing notes of value from the cash box and/or for supplying notes of value to the cash box. The separating and/or stacking module is arranged separately from the cash box. The cash box comprises a retraction element which is arranged in a swiveled-away position such that notes of value are suppliable through an opening of the cash box to said cash box and/or are removable therefrom, and which is arranged in a retaining position such that no notes of value are suppliable to and no notes of value are removable from the cash box.

DISCUSSION

The device is in particular an automated teller machine, an automatic cash register system and/or an automatic cash safe. With respect to automated teller machines, a distinction is made between cash dispensing machines in which notes of value can only be dispensed and so-called cash recycling machines. In cash recycling machines notes of value can be both deposited and dispensed. In particular, in cash recycling machines also deposited notes of value can be dispensed again.

From Document DE 10 2008 018 935 A1a device for handling single sheets for inputting and outputting notes of value respectively into and out of a container is known. The device for handling single sheets has a supply unit, comprising supply elements for sheet-by-sheet supplying of notes of value and for storing said notes of value in a notes of value stack in the container. Further, the device for handling single sheets has a separating device, comprising separating elements for the sheet-by-sheet removal of notes of value from the container. The supply elements and the separating elements are arranged separately from the container. The container is in particular a cash box. By arranging the separating and supplying elements separately in a separating and stacking module firmly arranged in an automated teller machine it is achieved that not each cash box has to include an individual separating and stacking module, but that only one such separating and stacking module has to be provided per receiving area in the safe of the automated teller machine. In this way, the space surrounded by the cash box can be used almost completely for receiving the notes of value. No complicated, expensive and complex mechanics for supplying and removing notes of value have to be provided in the cash box. In this way, a simple and cost-efficient structure of the cash box is achieved.

The cash box comprises a notes retracting flap by means of which the stack stored in the cash box can be compressed after the supply of one or more notes of value and by means of which it is prevented during the removal of the cash box from the automated teller machine that a note of value can escape from the cash box as long as a roller shutter, by means of which a supply opening through which the notes of value can be supplied and removed is closeable, is not yet closed. In a retaining position, the notes retracting flap contacts the note of value, facing the supply opening, of the notes of value stack received in the cash box. However, in a swiveled-away position, the notes retracting flap is swiveled away so far with respect to the retaining position from the notes of value stack that notes of value are suppliable to the cash box and notes of value are removable from the cash box. The cash box further comprises a spring by which the notes retracting flap is held in the retaining position. The separating and/or stacking module comprises a drive unit by means of which the notes retracting flap can be moved against the spring force of the spring from the retaining position to the swiveled-away position so that notes of value can be supplied to and removed from the cash box, when the cash box is inserted in the automated teller machine and is connected to the separating and/or stacking module. After the supply of at least one note of value the notes retracting flap is moved by means of the drive unit from the swiveled-away position to the retaining position and again in the swiveled-away position to compress the notes of value stack.

A disadvantage of this cash box structure is that the separating and/or stacking module inevitably has to comprise a drive unit so that the notes retracting flap after the insertion of the automated teller machine can be moved from the retaining position to the swiveled-away position, and thus notes of value can be supplied to and respectively removed from the cash box. Without such a drive unit the notes retracting flap remains in the retaining position so that no notes of value are suppliable to or respectively removable from the cash box. The cash box can thus only be used in automated teller machines having a separating and stacking module which has a drive unit. In contrast, in pure cash dispensing machines instead of a separating and stacking module only a separating module is provided by means of which notes of value can only be removed from the cash box. If no notes of value are supplied and thus a compression of the stack is not necessary, such separating modules do not need a drive unit for moving the notes retracting flap. Consequently, the previously described cash box cannot be used in pure cash dispensing machines or, if this is still desired, the separating modules of the cash dispensing machines have to be provided additionally with a drive unit only to move the notes retracting flap from the retaining position to the swiveled-away position. In particular, in order to achieve a cash cycle management of second order, each dispensing machine has to be provided with such separating modules which comprise a drive unit. This is associated with high costs. Further, due to this, more installation space is required. A cash cycle management of second order means that cash boxes are exchanged between a plurality of automated teller machines, automatic cash register systems and/or automatic cash safes without them having to be emptied and newly filled before.

SUMMARY OF THE INVENTION

It is an object of the invention to specify a device for handling notes of value which has a simple and cost-efficient structure and by means of which a cash cycle management of second order can be realized in a simple and cost-efficient manner.

By providing an elastic element which holds the retraction element in the swiveled-away position it is achieved that the cash box can also be used in pure cash dispensing machines whose separating modules for removing the notes of value from the cash box do not comprise a drive unit by means of which the retraction element can be moved between the retaining position and the swiveled-away position. By the elastic element it is achieved that the retraction element is automatically arranged in the swiveled-away position when the cash box is used in the device. Thus, also in pure cash dispensing machines no drive units have to be especially provided for moving the retraction element. In this way, a simple and cost-efficient structure of the cash dispensing machines is achieved and a universal use of the cash box in cash deposit machines, cash dispensing machines as well as cash recycling machines is assured. This universal use of such a simply structured cash box in all types of automated teller machines but also in all automatic cash register systems and/or automatic cash safes together with the separate arrangement of the separating and/or stacking module and the cash box results in an increasing attractiveness of a cash cycle management of second order, because the entire process is simplified, as only one type of cash box has to be used and because the cash box, which can often be broken during the operating life of an automated teller machine, can be cost-effectively replaced.

The retraction element is in particular a so-called notes retracting flap. The elastic element comprises in particular a spring, preferably a torsion spring. The torsion spring can be formed both as tension and as pressure spring. Such springs can be cost-efficiently obtained in an easy way, so that a cost-efficient structure of the device is achieved.

Further, it is advantageous when the retraction element in the retaining position contacts a note of value, arranged at the front side facing the opening of the cash box, of a notes of value stack arranged in the cash box and presses the notes of value stack against a counterpressure element. In this way, it is on the one hand achieved that, if a roller shutter closing the opening is open, still no note of value can accidentally fall out of the opening. Further, by arranging the retraction element in the retaining position a compression of the notes of value stack is achieved, so that correct stacking of the notes of value is assured and a controlled handling of the notes of value is achieved.

The cash box comprises in particular a storing area for storing notes of value in a stacked manner and a supply area for supplying notes of value from the separating and/or stacking module to the storing area and/or for the transfer of notes of value received in the storing area to the separating and/or stacking module. The storing area is in particular restricted by the counterpressure element, two lateral side walls of the cash box, the bottom of the cash box and the cover of the cash box. The counterpressure element is in particular a slide displaceable in the stacking direction of the notes of value by means of which it is achieved that the notes of value are stacked correctly and cannot tip over. During the transition from the swiveled-away position to the retaining position the retraction element transports a note of value arranged in the supply area to the receiving area. In this way, it is achieved that the supply area is free for the supply of a further note of value. Further, it is achieved that a note of value arranged in the supply area does not accidentally fall out of the device during the removal of the cash box.

The device is in particular a cash recycling machine or a cash dispensing machine. In a cash recycling machine, the separating and/or stacking module is formed such that by means thereof notes of value can be both supplied to the cash box as well as removed from the cash box. For this reason, in a cash recycling machine the separating and/or stacking module is generally referred to as separating and stacking module. However, in a cash dispensing machine, the separating module only serves for removing notes of value from the cash box. In particular, in cash recycling machines, the separating and/or stacking module preferably comprises a drive unit by means of which the retraction element is movable from the swiveled-away position to the retaining position and/or from the retaining position to the swiveled-away position. By moving the retraction element between the retaining position and the swiveled-away position and vice versa, it is achieved that the notes of value stack after the supply of one or more notes of value is compressed so that a correct stacking of the notes of value in the storing area of the cash box is assured.

In a particularly advantageous embodiment of the invention, during the transition from the swiveled-away position to the retaining position the drive unit moves the retraction element against the restoring force of the elastic element from the swiveled-away position to the retaining position and in doing so deforms the elastic element. In the reverse transition from the retaining position to the swiveled-away position the retraction element is however moved by the force of the elastic element. Thus, the drive unit only has to move the retraction element in one direction, i.e. from the swiveled-away position to the retaining position. It is advantageous when in a first operating state, the cash box is arranged in a receiving area of a safe of the device and thus notes of value are suppliable to and/or removable from the cash box and when in a second operating state the cash box is arranged outside of the safe. In the second operating state, the cash box is in particular completely removed from the device. The second operating state is thus inter alia said operating state in which the cash box is transported between a plurality of devices, in particular between a plurality of automated teller machines. The safe comprises in particular a plurality of receiving areas in which respectively one cash box is received. In a particularly preferred embodiment of the invention, the safe comprises four receiving areas in which four cash boxes are receivable.

It is advantageous when in the second operating state, i.e. in the operating state in which the cash box is removed from the safe, the retraction element is held against the restoring force of the elastic element by means of a holding element of the cash box in the retaining position and the elastic element is thus elastically deformed. In this way, it is assured that when the cash box is removed, the retraction element presses against a notes of value stack arranged in the cash box and thus slipping of the notes of value stack and of individual notes of value of the notes of value stack, respectively is prevented.

The retraction element is in particular connected to a first guiding element laterally projecting from the cash box which is at least temporarily engaged to a second guiding element of the receiving area during the transition from the first in the second operating state. Via said engagement, during the transition from the first in the second operating state, the retraction element is moved from the swiveled-away position, in which it is held by the elastic element, against the restoring force of the elastic element in the retaining position, in which it is held by the holding element. In this manner, it is achieved that during the removal of the cash box the retraction element is automatically moved from the swiveled-away position to the retaining position so that such swiveling of the retraction element is assured during the removal of the cash box.

The force required for moving the retraction element from the swiveled-away position to the retaining position, in particular the force which is required to deform the elastic element elastically, is preferably exerted during the manual removal of the cash box from the safe by the service team member removing the cash box. In this manner, it is achieved that no mechanics, in particular no drive unit, has to be provided which moves the retraction element during the removal of the cash box in the retaining position. Thus, in particular a drive unit of a separating module of a pure cash dispensing machine can be dispensed with.

While the retraction element is being held in the retaining position the holding element is in particular arranged in a holding position. In the receiving area in particular an operating element is arranged, wherein the operating element moves the holding element during the transition from the second in the first operation state, i.e. during the insertion of the cash box in the device, from the holding position to a released position in which the holding element no longer holds the retraction element in the retaining position. If the holding element is moved by the operating element from the holding position to the released position, the retraction element is released so that it is moved automatically from the retaining position to the swiveled-away position by the restoring force of the elastic element. Thus, it is achieved that during the insertion of the cash box the retraction element is automatically moved in the swiveled-away position and the separating and/or stacking module does not need to have actuating elements, in particular no drive unit, which moves the retraction element in the swiveled-away position, so that notes of value can be supplied to the cash box and/or removed from the cash box. Therefore, the cash box can also be used for pure cash dispensing machines, the separating module of which does not have a drive unit.

The holding element is in particular held by a spring in the holding position, wherein during movement of the holding element from the holding position to the released position by means of the operating element the spring is elastically deformed, so that the holding element after it is no longer held in the released position by the operating element moves automatically in the holding position.

Thus, it is altogether achieved that the retraction element when the cash box is removed is automatically arranged in the retaining position and the retraction element when the cash box is inserted is automatically arranged in the swiveled-away position without a drive unit within the cash box and/or within the device, in particular within the separating and/or stacking module being required therefor. In this way, a simple and cost-efficient structure of the device and the cash box is achieved. In particular, in this manner the cash box can be used both in cash recycling machines and in cash dispensing machines so that in a cash cycle management of second order only one universally useable type of cash box is required.

The operating element is in particular formed as a pin projecting from the separating and/or stacking module in the direction of the receiving area of the safe which contacts the holding element during the insertion of the cash box in the receiving area and moves it from the holding position to the released position. The first guiding element is in particular a pin projecting laterally from the cash box, whereas the second guiding element is in particular formed by a link by which the pin is guided during the removal of the cash box from the safe. In this way, the retraction element connected to the pin is moved from the swiveled-away position to the retaining position.

In a preferred embodiment of the invention, the cash box comprises a further elastic element which holds the retraction element in the swiveled-away position. This further elastic element is in particular formed identically to said one elastic element. In particular, both elastic elements are formed as torsion springs which are arranged at the sides of the retraction element facing the side walls of the cash box. In particular, the entire cash box is formed symmetrically to a center axis extending in the longitudinal direction of the cash box. The receiving area for receiving the cash box is also preferably formed symmetrically. In particular, also the previously described guiding elements and holding elements as well as the operating element is provided twice and arranged at both sides of the retraction element. In this way, it is achieved that the retraction element is moved uniformly over its entire length between the swiveled-away position and the retaining position and jamming or rotating of the retraction element due to the one-sided acting restoring force of only one elastic element is prevented.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which with reference to embodiments in connection with the enclosed Figures explains the invention in more detail.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
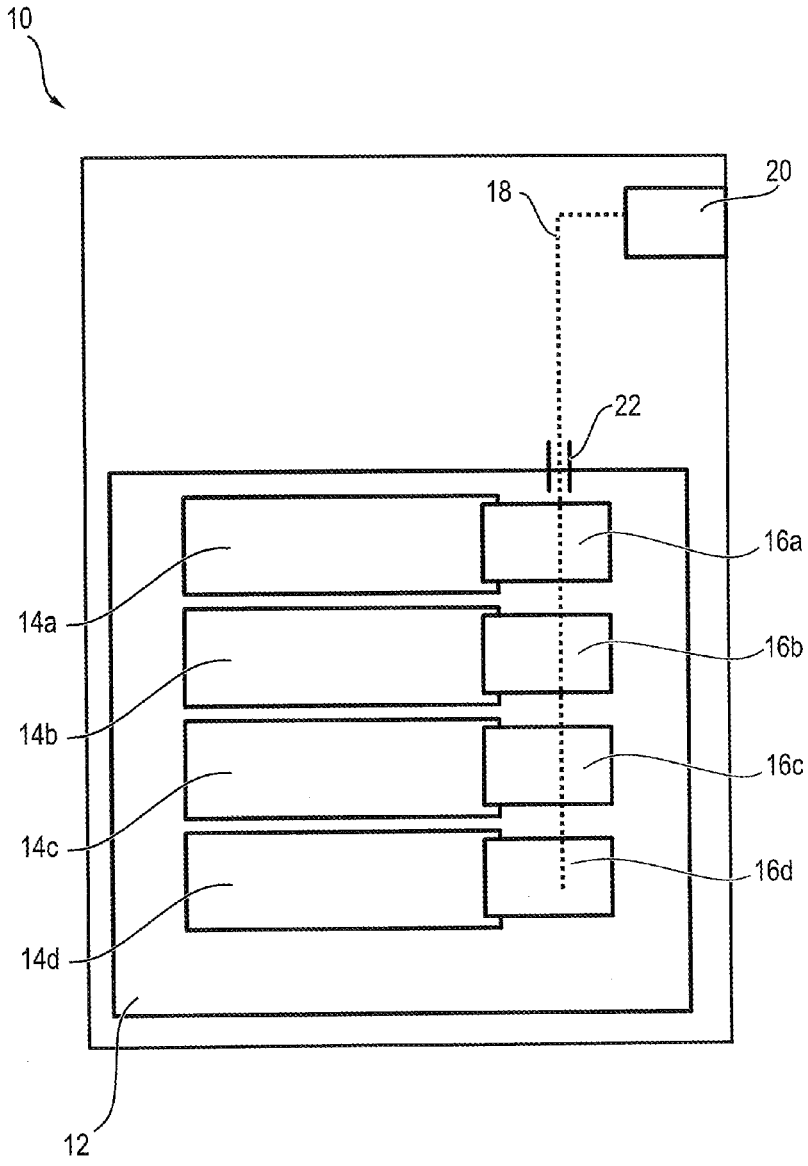
FIG. 1 shows a schematic illustration of a device for handling notes of value in a first operating state.

In FIG. 1, a schematic illustration of a device 10 for handling notes of value is illustrated. The device 10 is in particular an automated teller machine, an automatic cash register system and/or an automatic cash safe.

The device 10 comprises a safe 12 in which four cash boxes 14*a* to 14*d* are received. Further, the device 10 has four separating and/or stacking modules 16*a* to 16*d* by means of which notes of value received in the cash boxes 14*a* to 14*d* can be removed from the cash boxes 14*a* to 14*d* and/or notes of value can be supplied to the cash boxes 14*a* to 14*d*. Here, respectively one separating and/or stacking module 16*a* to 16*d* is assigned to one of the cash boxes 14*a* to 14*d*. Here, the cash boxes 14*a* to 14*d* are respectively arranged in a receiving area of the safe 12. The receiving area comprises in particular respectively two tracks laterally arranged at the safe walls in which the cash boxes 14*a* to 14*d* are guided during the insertion in the safe 12 and by which the cash boxes 14*a* to 14*d* are held in the safe 12.

The notes of value removed from the cash boxes 14*a* to 14*d* by means of the separating and/or stacking modules 16*a* to 16*d* are transported via a transport path 18 through a transfer slot 22 out of the safe 12 and supplied to an input and/or output compartment 20 via which the notes of value removed from the cash boxes 14*a* to 14*d* are dispensed to an operator of the device 10.

The notes of value deposited by an operator via the input and/or output compartment 20 are supplied via the transport path 18 and the transfer slot 22 to the separating and/or stacking modules 16*a* to 16*d* which supply the notes of value in turn to the cash boxes 14*a* to 14*d*.

The device 10 formed as automated teller machine can be both a so-called cash recycling machine and a cash dispensing machine. In a cash dispensing machine, notes of value are only removed from the cash boxes 14*a* to 14*d* and dispensed via the output compartment 20 to an operator, whereas no notes of value can be deposited and supplied to the cash boxes 14*a* to 14*d*. In this case, the separating and/or stacking modules 16*a* to 16*d* are only formed as separating modules by means of which notes of value can only be removed from but not supplied to the cash boxes 14*a* to 14*d*.

In contrast, in a cash recycling machine, notes of value can both be removed from and supplied to the cash boxes 14*a* to 14*d*. In particular, in a cash recycling machine, deposited notes of value can be dispensed again. In such a cash recycling machine, the separating and/or stacking modules 16*a* to 16*d* are formed as separating and/or stacking module 16*a* to 16*d* by means of which notes of value can both be supplied to and removed from the cash boxes 14*a* to 14*d*.

Figure 2:
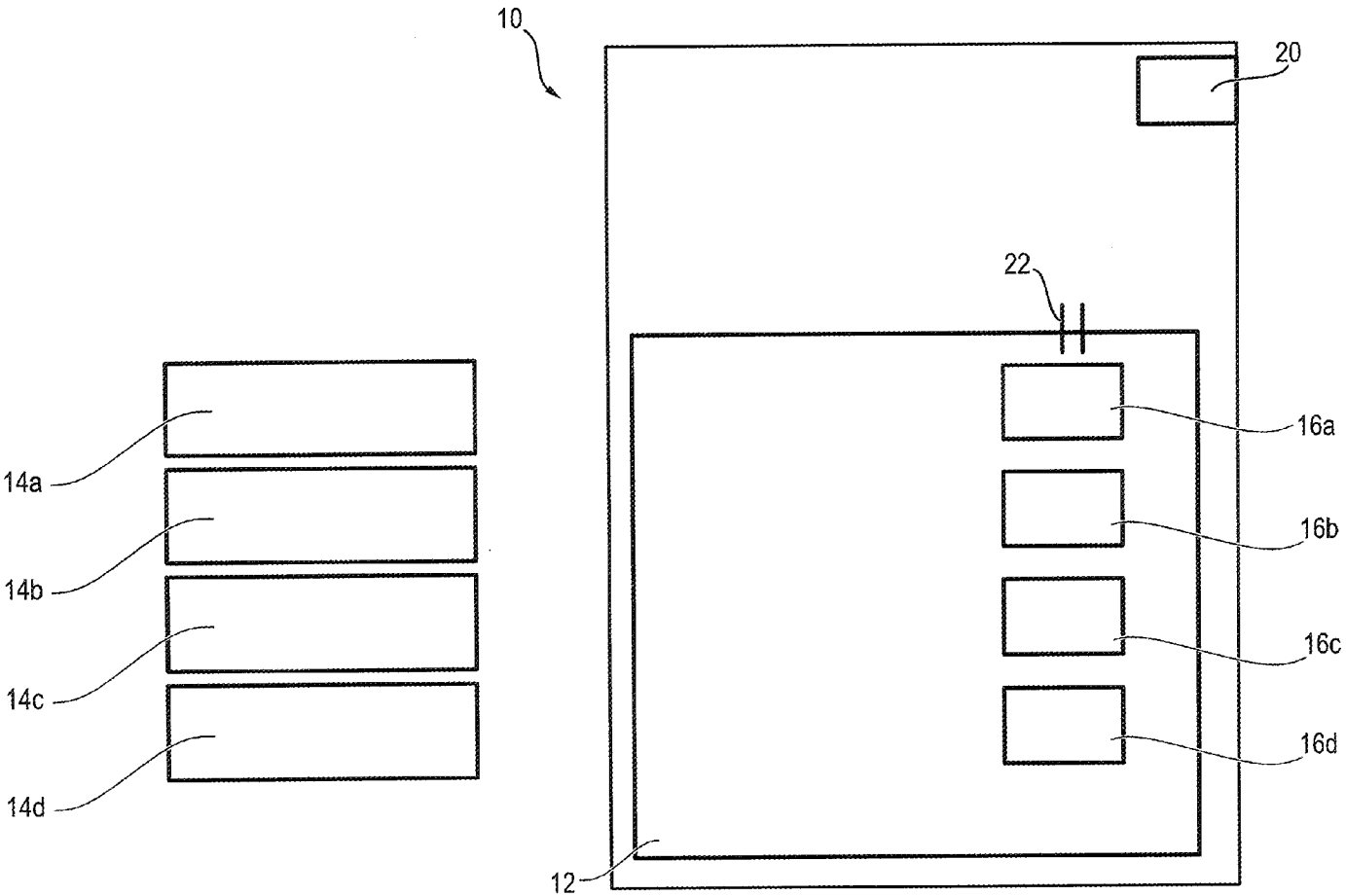
FIG. 2 shows a schematic illustration of the device according to FIG. 1 in a second operating state.

In FIG. 2, a schematic illustration of the device 10 in a second operating state is illustrated. Elements having the same structure or the same function are identified with the same reference signs. The second operating state is said operating state in which the cash boxes 14*a* to 14*d* are at least partially removed from the safe 12 of the device 10. In contrast, the first operating state is said operating state in which the cash boxes 14 a to 14*d* are inserted in the receiving areas 12 of the safe so that notes of value are suppliable to and/or removable from the cash boxes 14*a* to 14*d*.

The removed cash boxes 14*a* to 14*d* can be supplied, for example via a security transport company, to a cash center by emptying them and/or filling them with new notes of value. Alternatively, the cash boxes 14*a* to 14*d* can also be supplied directly to another device for handling notes of value, in particular another automated teller machine, automatic cash register system and/or automatic cash safe without the cash boxes 14*a* to 14*d* being emptied and newly filled before in a cash center. The supply of cash boxes 14*a* to 14*d* from a device for handling notes of value to another device for handling notes of value is also referred to as cash cycle management of second order. For such a cash cycle management of second order the expense required for the provision of devices for handling notes of value is considerably reduced as the cash boxes 14*a* to 14*d* do not always have to make the "detour" via a cash center. In particular, in this way it is achieved that cash boxes 14*a* to 14*d* can be directly exchanged between automated teller machines in which notes of value are mostly deposited and automated teller machines in which notes of value are mostly dispensed.

The separating and/or stacking modules 16*a* to 16*d* are firmly arranged in the safe 12 so that, during the removal of the cash boxes 14*a* to 14*d*, the separating and/or stacking modules 16*a* to 16*d* remain in the device 10 and are not taken out together with the cash boxes 14*a* to 14*d*. By this separation of the separating and/or stacking modules 16*a* to 16*d* from the cash boxes 14*a* to 14*d* it is achieved that the cash boxes 14*a* to 14*d* are formed in a simple and cost-efficient manner as they provide a relatively large storing area for the notes of value compared to the cash box size and only few mechanical elements have to be provided within the cash boxes 14*a* to 14*d*. Such a separation of functions between the separating and/or stacking modules 16*a* to 16*d* and the cash boxes 14*a* to 14*d* is known from patent application DE 10 2008 018 935 A1, the content of which is herewith incorporated by reference into the present description.

In order to realize an effective cash cycle management of second order it is necessary that the cash boxes 14*a* to 14*d* can be used both in cash recycling machines and in pure cash dispensing machines. That this is possible, despite the separation of functions between the cash box 14*a* to 14*d* and the separating and/or stacking modules 16*a* to 16*d*, is achieved by the structure of the cash boxes 14*a* to 14*d*, the separating modules 16*a* to 16*d* and the receiving areas of the safe 12 described in the following.

Figure 3:
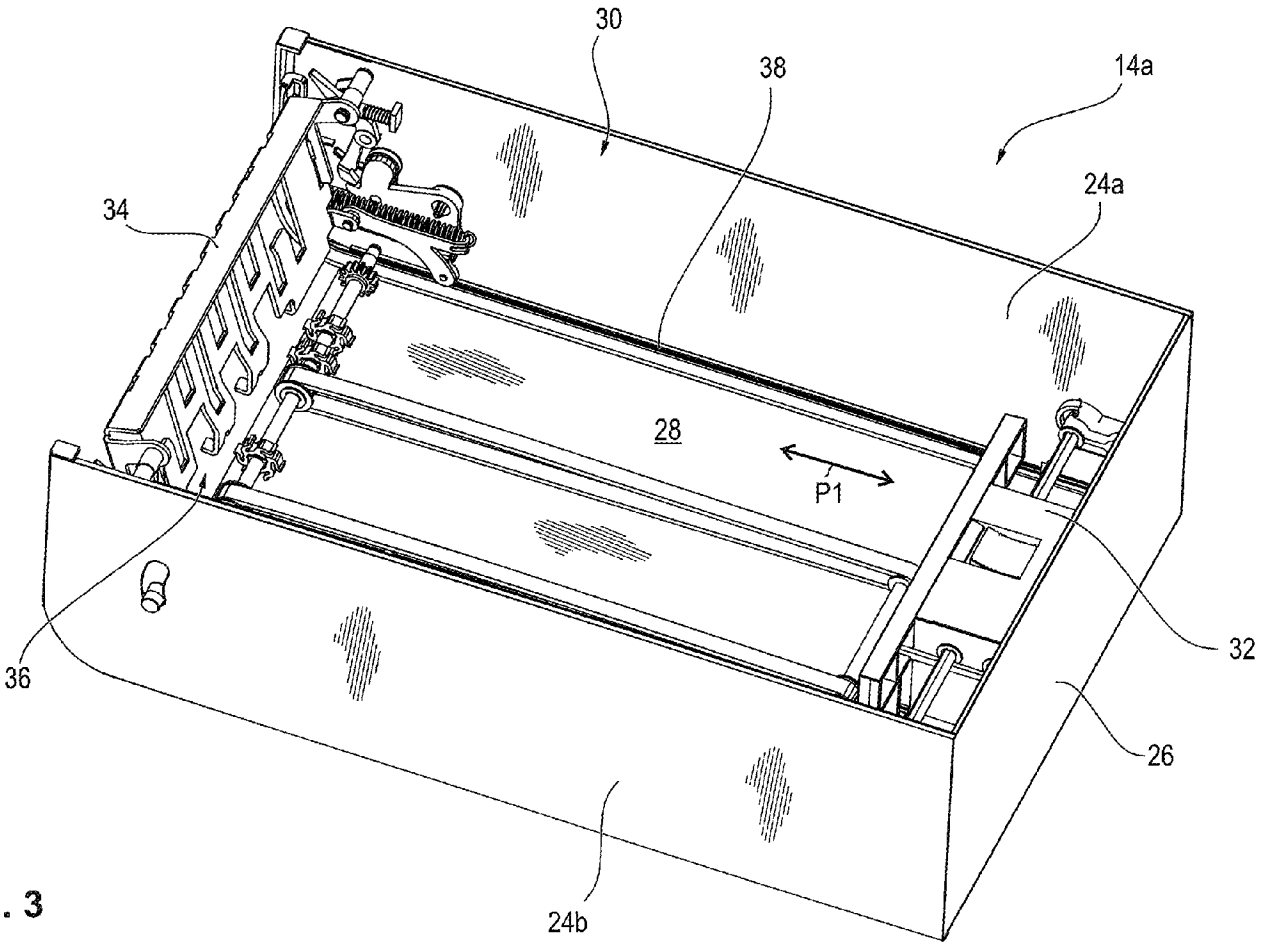
FIG. 3 shows a schematic perspective illustration of a cash box without a cover in the second operating state.

In FIG. 3, a schematic perspective illustration of a cash box 14*a* in the second operating state, i.e. a removed cash box 14*a*, is shown. The cash boxes 14*a* to 14*d* are in particular identically structured. Likewise, the receiving areas in the safe 12 in which the cash boxes 14*a* to 14*d* are received as well as the separating and/or stacking modules 16*a* to 16*d* are preferably respectively identically structured so that in the following only the structure of the first cash box 14*a*, of the first separating and/or stacking module 16*a* as well as the first receiving area of the safe 12 is described. The description applies accordingly to the other cash boxes 14*b* to 14*d*, the other separating and/or stacking modules 16*b* to 16*d* as well as the other receiving areas of the safe 12.

The cash box 14*a* comprises two side walls 24*a*, 24*b*, a rear wall 26, a bottom element 28 and a cover not illustrated in FIG. 3 which can be opened for the removal of notes of value by service team members and/or for loading the cash box 14*a* by a service team member. By the side walls 24*a*, 24*b*, the rear wall 26 and the bottom element 28 a storing area 30 is restricted in which the notes of value received in the cash box 14*a* can be stored in a stacked manner. Further, the cash box 14*a* comprises a counterpressure element 32 against which the notes of value stack received in the storing area 30 is pressed so that the note of value, facing the counterpressure element 32, of the notes of value stack is adjacent to the counterpressure element 32 and thus a correct stacking of the notes of value is ensured. The counterpressure element 32 is in particular formed as a slide movable in the direction of the double arrow P1, wherein the slide 32 is always moved so far that the storing area 30 is restricted by the slide 32 to the size of the notes of value stack received in the storing area 30.

Further, the cash box 14*a* comprises a retraction element 34 formed as notes retracting flap. In the second operating state shown in FIG. 3, i.e. when the cash box 14*a* is removed, the retraction element 34 is arranged in a retaining position in which it contacts the note of value, facing it, of the notes of value stack received in the storing area 30 and presses the notes of value stack against the counterpressure element 32.

The cash box 14*a* has an opening 36 through which the notes of value in the first operating state, i.e. when the cash box 14*a* is inserted in the device 10, are suppliable to the cash box 14*a* and/or are removable from the cash box 14*a*. In the removed state, the opening 36 is closed by a roller shutter not illustrated in FIG. 3. The roller shutter is guided in guide rails 38 of the side walls 24*a*, 24*b* and is opened, preferably automatically, during the insertion of the cash box 14 in the device 10 and is closed automatically during the removal of the cash box 14*a* from the device 10. By the retraction element 34 it is prevented that the note of value, facing the retraction element 34, of the notes of value stack accidentally falls out of the opening 36 when the opening 36 is open, i.e. when the roller shutter is open, in particular during the removal of the cash box 14*a*. Further, by the retraction element 34 arranged in the retaining position 34 it is achieved that the notes of value of the notes of value stack received in the cash box 14*a* cannot tip over during the transport of the cash box 14*a*. In this way, it is achieved that during the insertion of the cash box 14*a* in the device 10 the notes of value can be removed in a problem-free manner by means of the separating and/or stacking module 16*a* and further notes of value can be supplied, respectively. The retraction element 34 is connected to the side walls 24*a*, 24*b* of the cash box 14*a* via two adjustment mechanisms 40, 42. Via said adjustment mechanisms 40, 42 the retraction element 34 is moved between the retaining position and a swiveled-away position. The swiveled-away position of the retraction element 34 is said position in which the retraction element 34 does no longer contact the notes of value stack and notes of value are suppliable to the storing area 30 or removable from the storing area 30.

Figure 4:
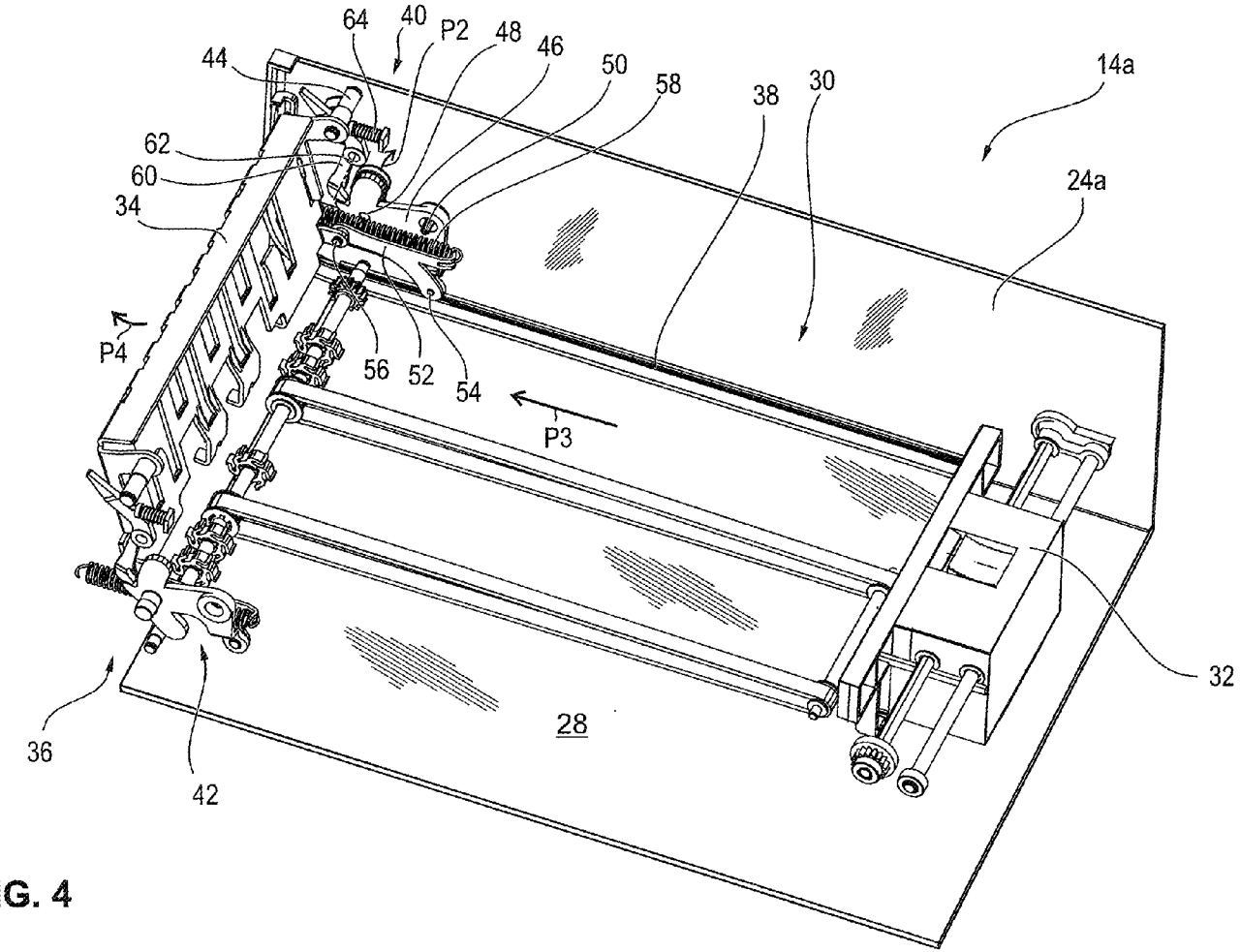
FIG. 4 shows a further schematic perspective illustration of the cash box according to FIG. 3 in the second operating state.

The adjustment mechanisms 40, 42 are in particular identically formed so that in the following only the structure of the first adjustment mechanism 40 is described. The adjustment mechanism 42 is structured correspondingly. In an alternative embodiment of the invention, also only one adjustment mechanism 40, 42 can be provided. Likewise alternatively, the two adjustment mechanisms 40, 42 can also be formed differently. By providing two adjustment mechanisms 40, 42 it is achieved that the retraction element 34 is uniformly connected to both side walls 24*a*, 24*b* and is, in particular during adjustment between the retaining position and the swiveled-away position, moved uniformly. In this way, jamming, tipping and/or rotating of the retraction element 34 during adjustment between the positions is prevented. In FIG. 4, the second side wall 24*b* is faded out, so that both adjustment mechanisms 40, 42 are clearly visible.

The retraction element 34 is connected to the first side wall 24*a* via a pin 44 and is mounted via said pin 44 about the longitudinal axis of the pin 44. Further, the adjustment mechanism 40 comprises a swivel element 46 which is connected rotatably about an axis of rotation 50 to the first side wall 24*a*. Further, the swivel element 46 is guided via a pin 48 in a groove of the first side wall 24*a*. Via said pin 48 and the groove the swiveling area in which the swivel element 46 can be swiveled about the axis 50 is restricted. If the retraction element 34, as shown in FIGS. 3 and 4, is arranged in the retaining position, the swivel element 46 is arranged in a lower position in which the pin 48 is arranged at the lower end of the groove of the first side wall 24*a*. The pin 48 is in particular connected stationarily and rotatably to the swivel element 46. The swivel element 46 and the retraction element 34 are connected to each other via a connecting element 52, wherein the retraction element 34 and the connecting element 52 as well as the connecting element 52 and the swivel element 46 are respectively connected via a pin 54, 56 to each other and are thus rotatable relative to each other. Further, the connecting element 52 is connected to the first side wall 24*a* via a spring 58, wherein the spring 58 is tensioned, i.e. elastically deformed, in the retaining position of the retraction element 34.

Further, the adjustment mechanism 40 comprises a holding element 60 which, in the second operating state shown in FIGS. 3 and 4 is arranged in a holding position in which it contacts the swivel element 46 and holds the swivel element 46 in the lower position. Without the holding element 60 the swivel element 46 would be swiveled from the lower position to an upper position in the direction of the arrow P2. Further, the connecting element 52 would be moved in the direction of the arrow P3 and the retraction element would be swiveled in the direction of the arrow P4 and thus be moved from the retaining position to the swiveled-away position. Thus, by the holding element 60 it is achieved in the second operating state that the retraction element 34 is held in the retaining position against the restoring force of the spring 58.

The holding element 60 is mounted rotatably about an axis of rotation 62 and is connected to the first side wall 24*a*. Further, the holding element 60 is connected via a pressure spring 64 to the first side wall 24*a*. In the second operating state illustrated in FIGS. 3 and 4, i.e. when the cash box 14*a* is removed, the holding element 60 is arranged in a holding position in which the pressure spring 64 is not compressed so that the pressure spring 64 does not exert a force on the holding element 60.

Figure 5:
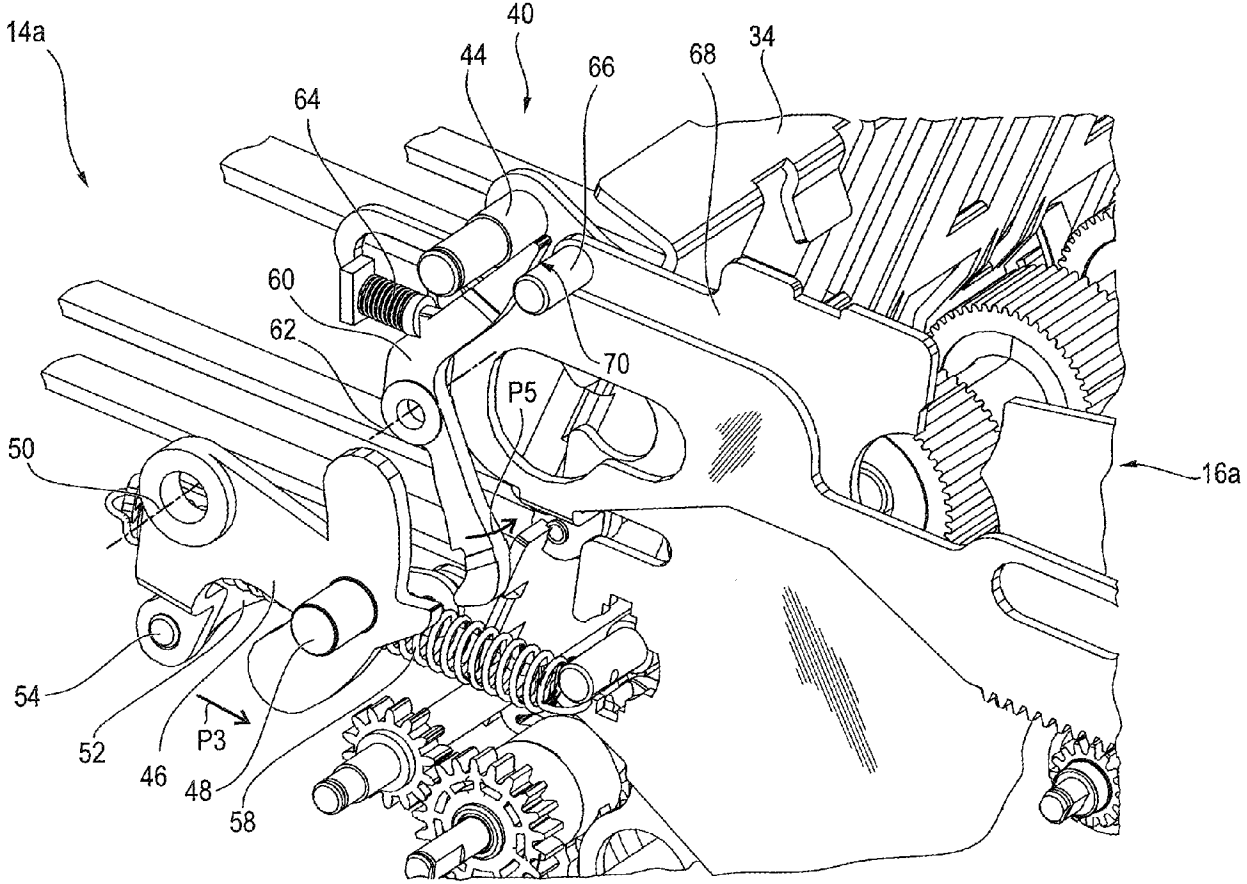
FIG. 5 shows a schematic perspective illustration of a section of the cash box according to FIGS. 3 and 4.

In FIG. 5, a schematic perspective illustration of a section of the cash box 14*a* and the separating and/or stacking module 16*a* during the transition from the second operating state in the first operating state is shown. The first side wall 24*a* of the cash box 14*a* is faded out.

The separating and/or stacking module 16*a* comprises a pin 66 firmly connected to a side plate 68 which during the insertion of the cash box 14*a* in the receiving area of the safe 12 and thus during the transition from the second in the first operating state presses against a contact surface 70 of the holding element 60 and rotates the holding element 60 in the direction of the arrow P5 about the axis of rotation 62 so that the holding element 60 does no longer contact the swivel element 46 and the swivel element 46 is thus no longer held in the lower position. In the transitional state shown in FIG. 5, just said state is shown in which the holding element 60 by the contact to the pin 66 has been rotated from the holding position in the direction of the arrow P5 in a released position, but the swivel element 46 has not yet moved out of the lower position. The pressure spring 64 is compressed against its spring force by the rotation of the holding element 60 so that the holding element 60 when the pin 66 does no longer contact the contact surface 70 would be moved by the restoring force of the pressure spring 64 again from the released position to the holding position. The force required for the compression of the pressure spring 64 is exerted by the service team member who inserts the cash box 14*a* in the receiving area of the safe 12. In an alternative embodiment of the invention, the pin 66 can also be attached to the safe 12.

After the holding element 60 has been swiveled from the holding position to the released position, the connecting element 52 is moved by the spring force of the spring 58 in the direction of the arrow P6, i.e. towards the separating and/or stacking module 16*a*. In this manner, also the swivel element 46 connected to the connecting element 52 is swiveled in the direction of the arrow P2 and thus moved from the lower position to the upper position. Hereby, the swivel element 46 is guided via the pin 48 in a groove, not illustrated in FIG. 5, of the first side wall 14*a*. Further, by the movement of the connecting element 52 in the direction of the arrow P3 the retraction element 34 is swiveled in the direction of the arrow P4 and thus moved from the retaining position to the swiveled-away position. Thus, the movement of the retraction element 34 from the retaining position to the swiveled-away position takes place automatically during the insertion of the cash box 14*a* in the safe 12 due to the restoring force of the spring 56 tensioned in the second operating state. A drive unit of the separating and/or stacking module 16*a* is thus, different to what is known from prior art, not required for the movement of the retraction element 34 from the retaining position to the swiveled-away position. The cash box 14*a* can thus also be used in devices 10, the separating and/or stacking module 16*a* of which does not have a drive unit for moving the retraction element 34. This is in particular the case for pure cash dispensing machines which only have a separating module which does not require a drive unit as a movement of the retraction element 34 for compressing the stack is not necessary as no notes of value are supplied to the cash box 14*a*.

Figure 6:
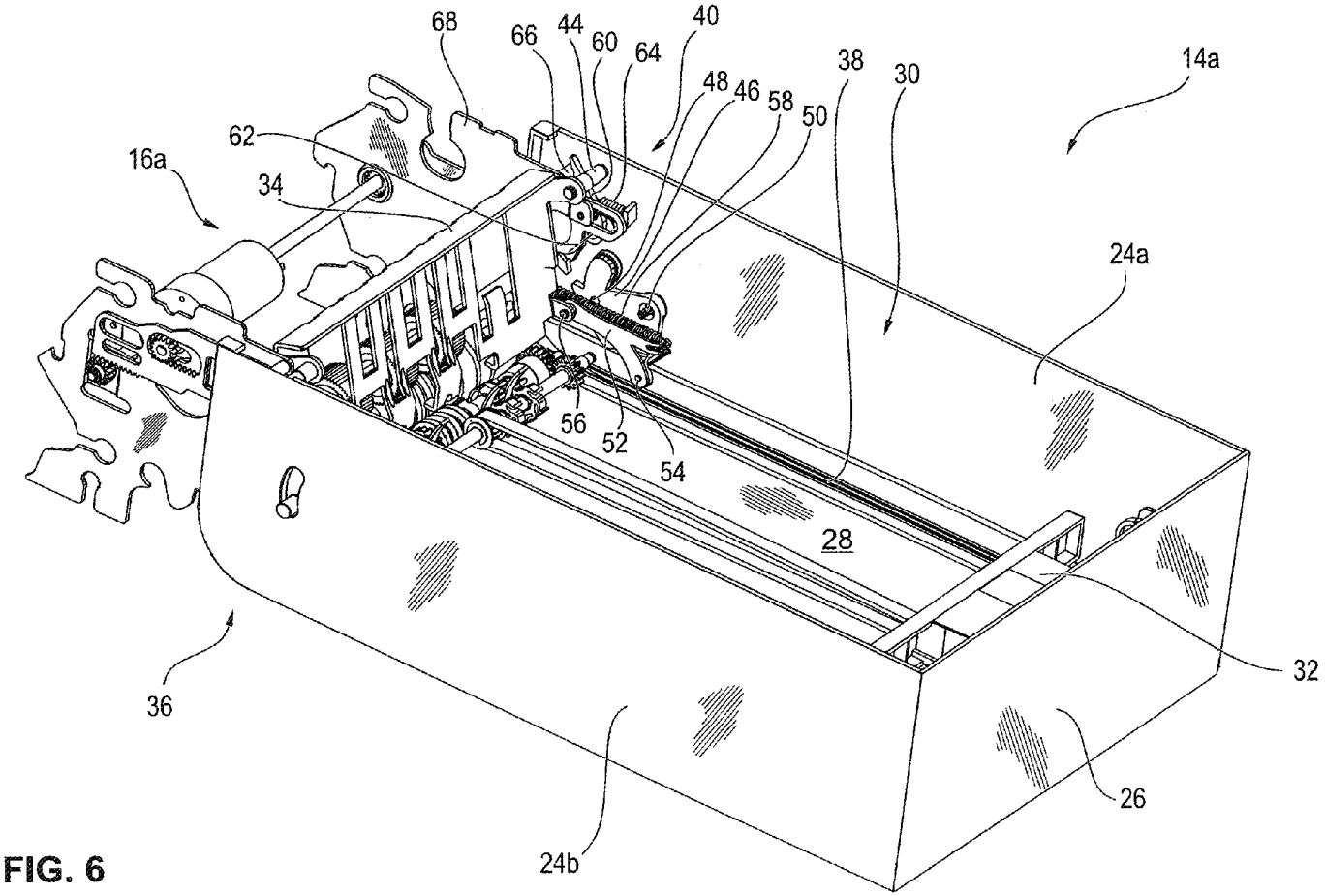
FIG. 6 shows a schematic perspective illustration of the cash box according to FIGS. 3 to 5 during the transition from the second in the first operating state.

In FIG. 6, a schematic perspective illustration of the cash box 14*a* and the separating and/or stacking module 16*a* during the transition from the second in the first operating state is illustrated. Hereby, in FIG. 6 the transitional state is shown as in FIG. 5.

Figure 7:
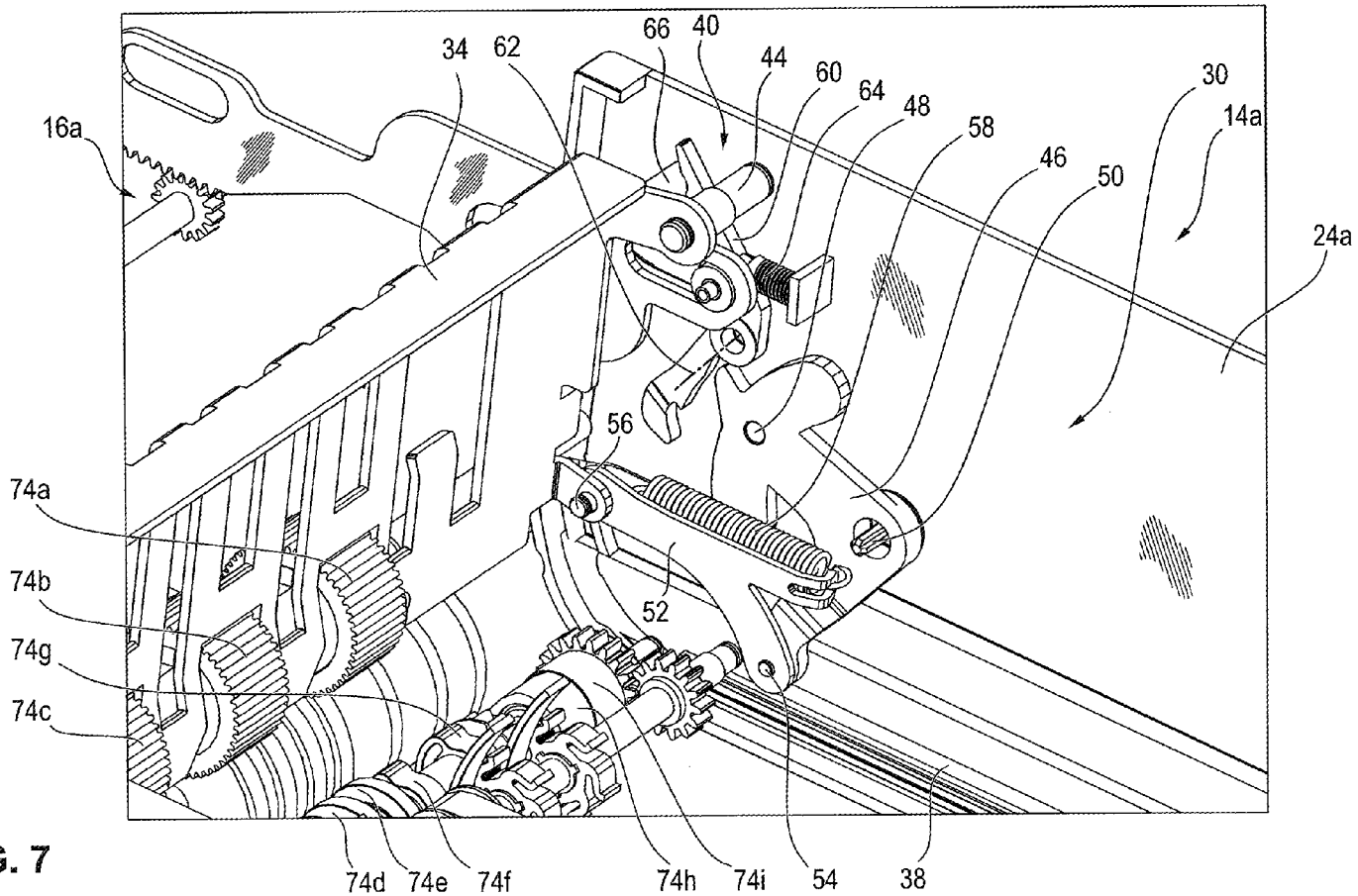
FIG. 7 show a schematic perspective illustration of a section of the cash box according to FIGS. 3 to 6 in the first operating state.

In FIG. 7, a schematic perspective illustration of a section of the cash box 14*a* and the separating and/or stacking module 16*a* in the second operating state, i.e. when the cash box 14*a* is inserted in the safe 12, is shown. The retraction element 34 is arranged in the swiveled-away position in FIG. 7 so that notes of value can be supplied to and/or removed from the cash box 14*a* through the opening 36. The separating and/or stacking module 16*a* comprises a plurality of transport elements 74*a* to 74*i* by means of which the notes of value are suppliable to and/or removable from the cash box 14*a*. The retraction element 34 respectively has multiple recesses through which a part of the transport elements 74*a* to 74*c* projects when the retraction element 34 is arranged in the swiveled-away position.

Figure 8:
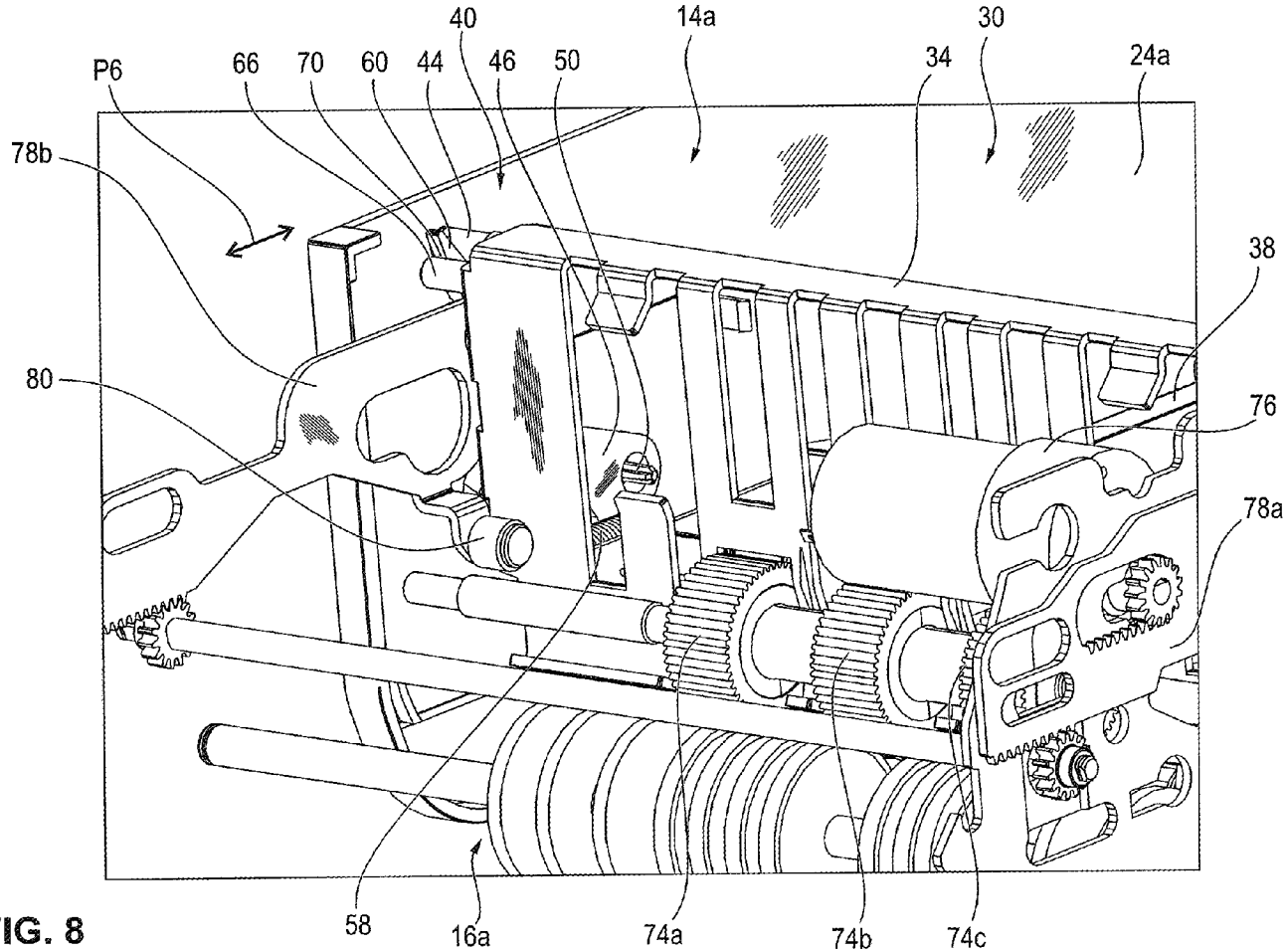
FIG. 8 shows a schematic perspective illustration of a section of the cash box and a section of the separating and/or stacking module in the first operating state.

In FIG. 8, a schematic perspective illustration of a further section of the cash box 14*a* and the separating and/or stacking module 16*a* is shown. The retraction element 34*a* is also arranged in the swiveled-away position. The separating and/or stacking module 16*a* comprises a drive unit 76, in particular an electric motor and/or a stepper motor. The drive unit 76 is connected via gears and shafts with two sliders 78*a*, 78*b* which can be moved via the drive unit 76 in the direction of the double arrow P6. The sliders 78*a*, 78*b* are respectively firmly connected to a roll 80 which contact the retraction element 34. If the sliders 78*a*, 78*b* are moved by means of the drive unit 76 in the direction of the cash box 14*a*, the retraction element 34 is moved opposite to the direction of the arrow P4 from the swiveled-away position to the retaining position via the contact with the rolls 80. In this manner, it is made possible by the drive unit 76 that in the first operating state, i.e. when the cash box 14*a* is inserted, the retraction element 34 is movable against the spring force of the spring 58 from the swiveled-away position to the retaining position so that in an automated teller machine 10 in which notes of value can also be supplied to the cash box 14*a* the notes of value stack can be compressed by swiveling of the retraction element 34 from the swiveled-away position to the retaining position. If the sliders 78*a* and 78*b* and thus the rolls 80, after they have moved the retraction element 34 from the swiveled-away position to the retaining position, are again moved back away from the cash box 14*a*, the retraction element 34 is again moved from the retaining position to the swiveled-away position by the spring force of the spring 58 so that notes of value can again be supplied to and/or removed from the cash box 14*a*.

Figure 9:
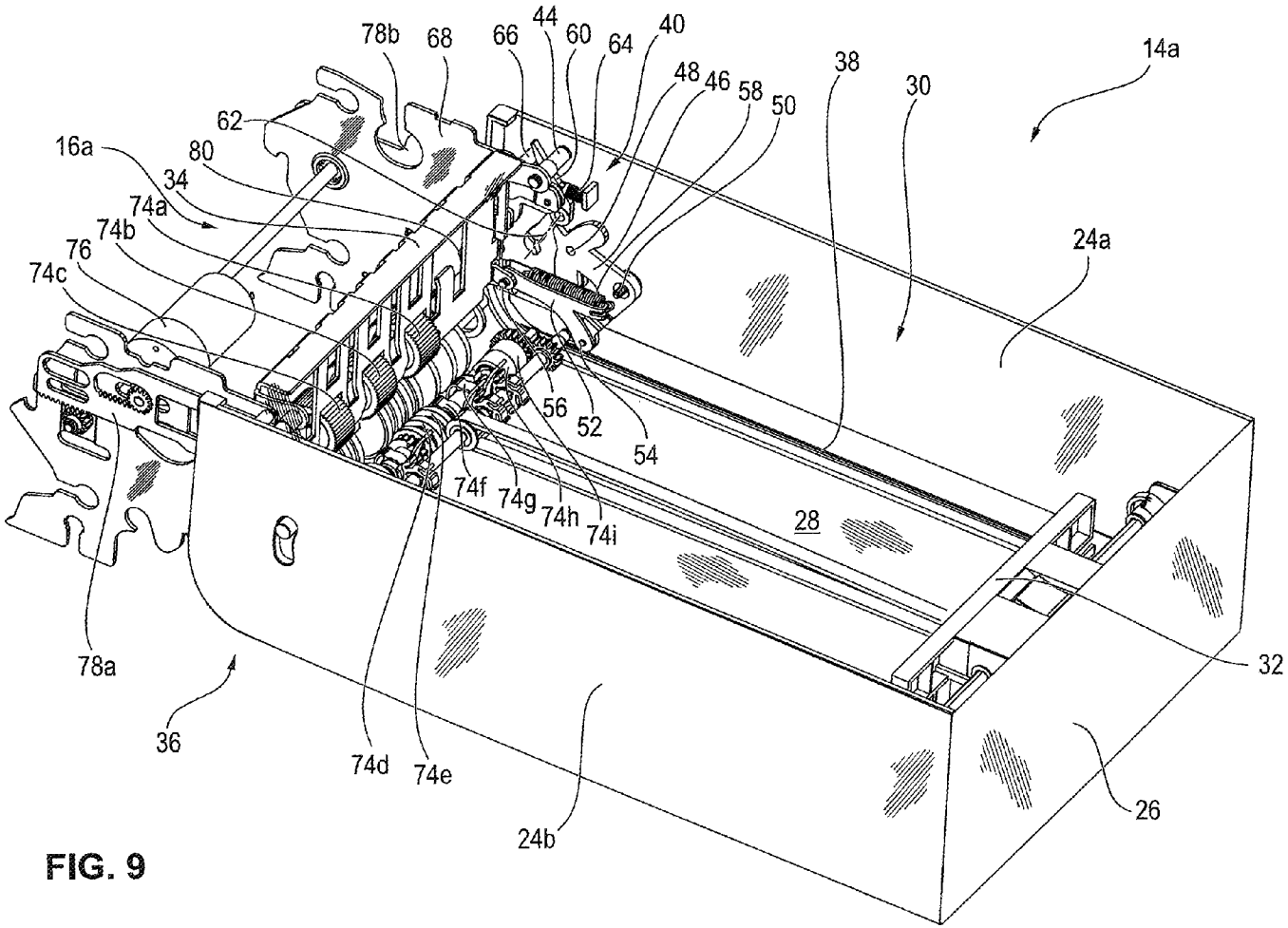
FIG. 9 shows a schematic perspective illustration of the cash box and the separating and/or stacking module in the first operating state.

In FIG. 9, a schematic perspective illustration of the cash box 14*a* and the separating and/or stacking module 16*a* is shown in the second operating state. As in FIG. 8, in FIG. 9 the retraction element 34 is illustrated in the swiveled-away position.

Figure 10:
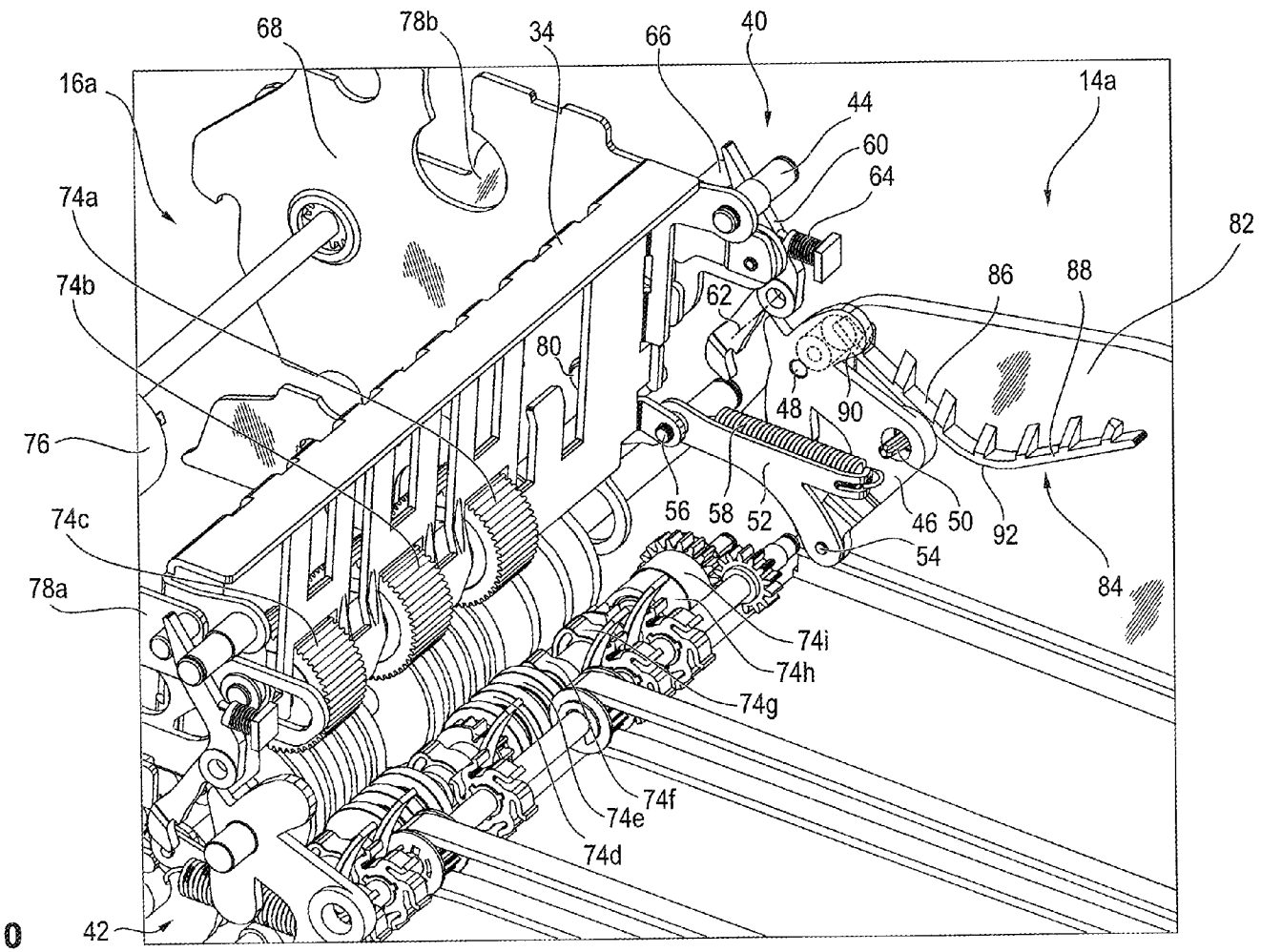
FIG. 10 shows a schematic perspective illustration of a section of the cash box, the separating and/or stacking module and a receiving area of a safe of the device in the first operating state.

In FIG. 10, a schematic perspective illustration of a section of a cash box 14*a* of the separating and/or stacking module 16*a* and a rack part 82 of the receiving area of the safe 12 for the first cash box 14*a* is illustrated. The rack part 82 comprises a guiding element 84, which is formed approximately V-shaped, and comprises a first portion 86 which in FIG. 10 extends from the top left to the bottom right and a second portion 88 which in FIG. 10 extends from the bottom left to the top right.

In the second operating state shown in FIG. 10, i.e. when the cash box 14*a* is inserted, the pin 48 of the swivel element 46 arranged in the upper position contacts a contact surface 90 of the first portion 86 of the guiding element 84, provided that the retraction element 34 is arranged in the swiveled-away position and has not been moved by the drive unit 76 in the retaining position. Here, the pin contacts the first portion 86 of the guiding element 84 at an upper end portion, facing the separating and/or stacking module 16*a*, of the first portion 86.

If the cash box 14*a* is removed from the safe 12, e.g. by a service team member, i.e. during the transition from the first operating state in the second operating state, the pin 48 contacts, when the cash box 14*a* is being pulled out of the storing area, the contact surface 90 of the first portion 86 of the guiding element 84 and is moved below via said contact in the direction of the arrow P7. Here, the swivel element 46 is swiveled opposite to the direction of the arrow P2 so that also the connecting element 52 connected to the swivel element 46 as well as the retraction element 34 are moved along. The retraction element 34 is thus moved from the swiveled-away position to the retaining position, whereby the spring 58 is tensioned against its restoring force. The force required for this is exerted by the service team member during the removal of the cash box 14*a*.

If the cash box 14*a* is pulled out of the receiving area of the safe 12 so far that the pin 48 is arranged at the lowest point 92 of the guiding element 84, i.e. at said position at which the first portion 86 and the second portion 88 are connected to each other, the swivel element 46 is in the lower position and the retraction element 34 is arranged in the retaining position. When removing the cash box 14*a* from the device 10, the holding element 60 loses contact to the pin 66 so that the holding element 60 due to the restoring force of the pressure spring 64 is moved from the released position to the holding position. If the cash box 14*a* is removed so far that the pin 48 is arranged at the lowest point 92 and thus also the swivel element 46 is arranged in the lower position, the holding element 70 does no longer contact the pin 66 so that the holding element 70 is arranged in the holding position and prevents that the swivel element 46 is moved back again in the upper position by the spring force of the spring 58. In this way, it is achieved that also the retraction element 34 is held in the retaining position by the holding element 70.

Figure 11:
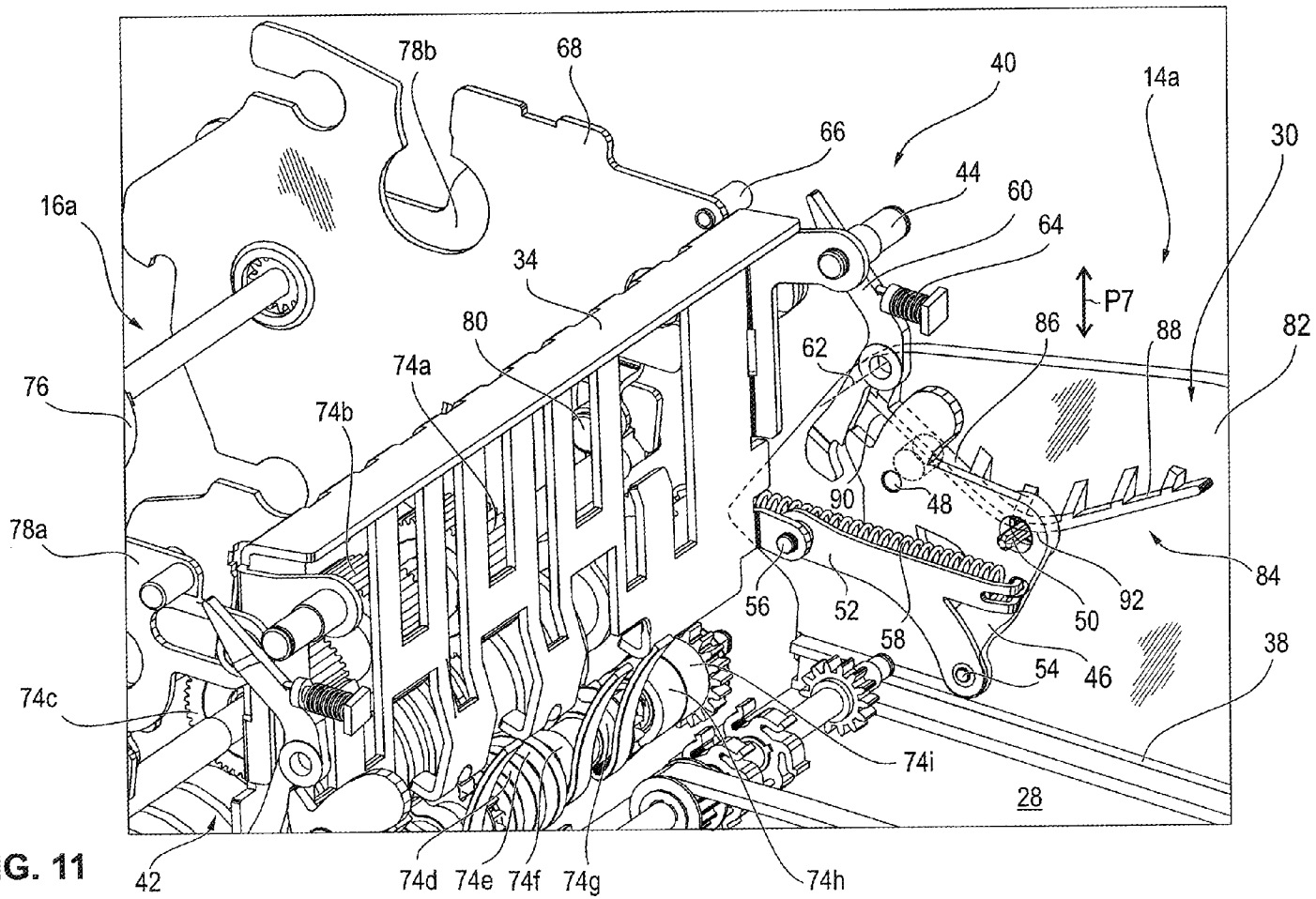
FIG. 11 shows a schematic perspective illustration of the section according to FIG. 10 during the transition from the first in the second operating state.

In FIG. 11, a schematic perspective illustration of a section of the cash box 14*a*, of the separating and/or stacking module 16*a* and the rack part 82 during the transition from the first in the second operating state is shown. The cash box 14*a* is moved out of the safe 12 so far, that the retraction element 34 is no longer arranged in the swiveled-away position, but also not yet in the retaining position. Here, the pin 66 contacts the first portion 86 at a contact area positioned between the highest point and the lowest point 92.

Figure 12:
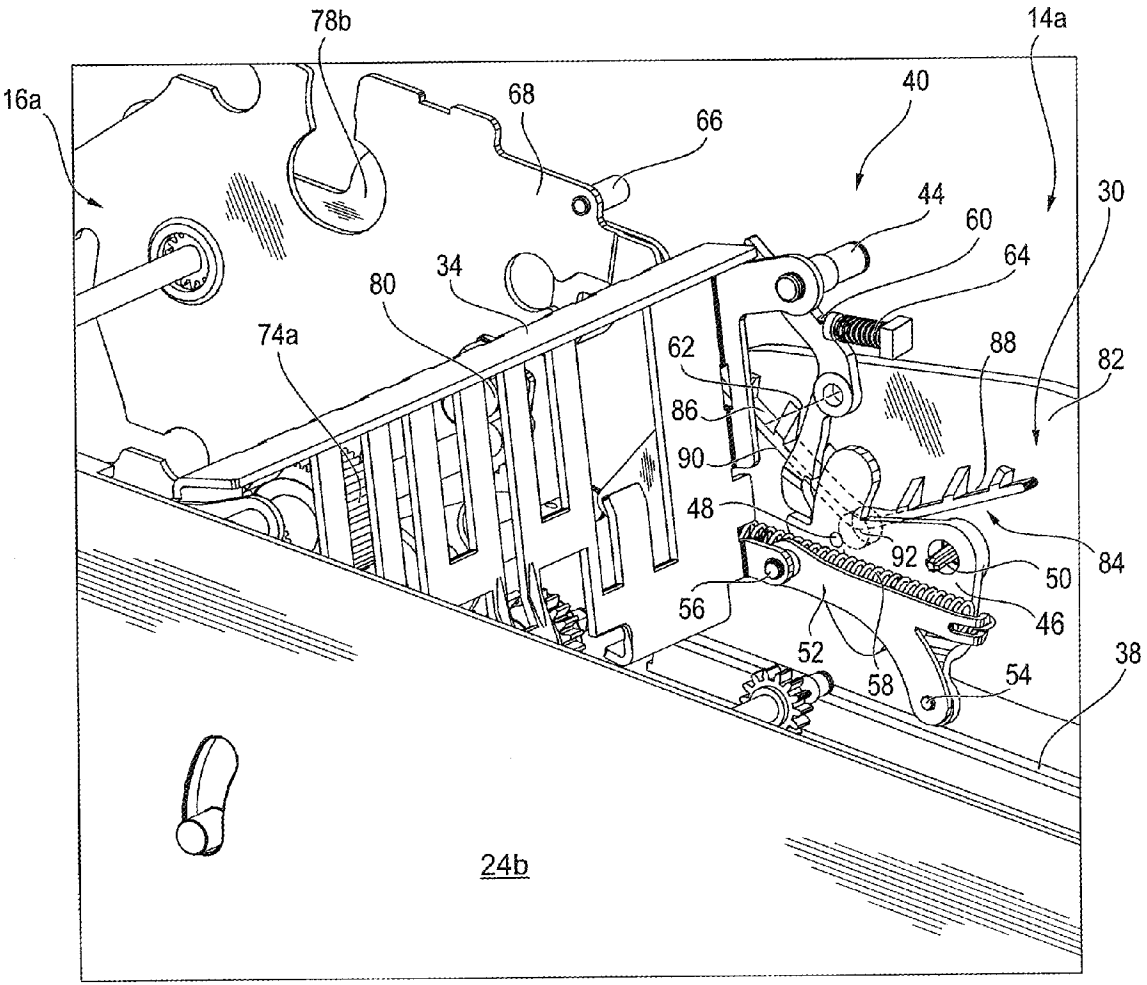
FIG. 12 shows a further schematic perspective illustration of a section of the cash box, the separating and/or stacking module and the receiving area of the safe during the transition from the first in the second operating state.

In FIG. 12, a schematic perspective illustration of a section of the cash box 14*a*, the separating and/or stacking module 16*a* and the rack part 82 is shown.

The cash box 14*a* is moved out of the safe 12 so far that the retraction element 34 is arranged in the retaining position. The swivel element 46 is arranged in the lower position and the holding element is arranged in the holding position.

The second portion 88 of the guiding element 84 is provided so that also a cash box 14*a* can be supplied to the device 10 in which the retraction element 34 is arranged in the swiveled-away position and thus the pin 48 and the swivel element 46 are arranged in the upper position. By the contact of the pin 48 to the second portion 88 during the insertion of the cash box 14*a* in the receiving area of the safe 12 it is achieved that the swivel element 46 is moved from the upper in the lower position and thus the retraction element 34 is moved from the swiveled-away position to the retaining position. In an alternative embodiment of the invention, the guiding element 84 can also comprise only the first portion 86. In summary, it is thus achieved that the retraction element 34 during the removal of the cash box 14 is automatically moved in the retaining position without a drive unit being required for this purpose. Here, the spring 58 is tensioned so that later during the insertion of the cash box 14*a* in another device for handling notes of value, in particular in another automated teller machine, the retraction element 34 is again moved by a respective operation of the holding element 60 from the retaining position to the swiveled-away position so that notes of value are suppliable to and/or removable from the cash box 14*a*. Thus, via the respective arrangement of the spring 58 as well as via providing the guiding element 84 and the corresponding mechanics of the cash box 14*a* it is achieved that the cash box 14*a* can be used universally both in cash recycling machines and in pure cash dispensing machines, and that the separating and/or stacking modules of cash dispensing machines do not need to have a drive unit for moving the retraction element 34. Thus, despite the separation of functions between the cash box 14*a* and the separating and/or stacking module 16*a* a simple and cost-efficient structure of the device 10 is achieved. In this manner, in particular an effective cash cycle management of second order can be realized, as the cash box 14*a* can be used universally in all devices for handling notes of value.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A device for handling notes of value, comprising at least one cash box for receiving notes of value, and comprising at least one separating and/or stacking module for removing notes of value from the cash box and/or for supplying notes of value to the cash box, wherein the separating and/or stacking module is arranged separately from the cash box, and wherein the cash box comprises a retraction element which is arranged in a swiveled-away position such that notes of value are suppliable to the cash box by means of the separating and/or stacking module through an opening of the cash box and/or are removable from the cash box, and which is arranged in a retaining position such that no notes of value are suppliable to and no notes of value are removable from the cash box, wherein the cash box comprises an elastic element which holds the retraction element in the swiveled-away position;

wherein in a first operating state ash box is arranged in a receiving area of a safe of the device and notes of value are suppliable to the cash box and/or are removable from the cash box, and that in a second operating state the cash box is arranged outside of the safe; and wherein in the second operating state the retraction element is held in the retaining position against the restoring force of the elastic element by means of a holding element of the cash box and that the elastic element is elastically deformed.

2. The device according to claim 1, wherein the elastic element comprises a spring, in particular a torsion spring.

3. The device according to claim 1, wherein the retraction element in the retaining position contacts a note of value arranged at the front side, facing the opening of the cash box, of a notes of value stack arranged in the cash box and presses the notes of value stack against a counterpressure element.

4. The device according to claim 1, wherein the cash box comprises a storing area for storing notes of value in a stacked manner and a supply area for supplying notes of value from the separating and/or stacking module to the storing area and/or for the transfer of notes of value received in the storing area to the separating and/or stacking module, and that the retraction element during the transition from the swiveled-away position to the retaining position transports a note of value arranged in the supply area to the storing area.

5. The device according to claim 1, wherein the separating and/or stacking module comprises a drive unit by means of which the retraction element is movable from the swiveled-away position to the retaining position and/or from the retaining position to the swiveled-away position.

6. The device according to claim 5, wherein the drive unit during the transition from the swiveled-away position to the retaining position moves the retraction element against a restoring force of the elastic element from the swiveled-away position to the retaining position and in doing so elastically deforms the elastic element, and that during the transition from the retaining position to the swiveled-away position the elastic element deformed by the drive unit moves the retraction element from the retaining position to the swiveled-away position.

7. The device according to claim 1, wherein the retraction element is connected to a first guiding element projecting from the cash box, that the receiving area comprises a second guiding element, that the first guiding element and the second guiding element during the transition from the first to the second operating state are at least temporarily engaged to each other, that via said engagement during the transition from the first to the second operating state the retraction element is moved from the swiveled-away position to the retaining position, and that the holding element holds the retraction element after the transition from the first to the second operating state in the retaining position.

8. The device according to claim 7, wherein the retraction element during the transition from the first to the second operating state is moved automatically from the swiveled-away position to the retaining position.

9. The device according to claim 7, wherein the first guiding element comprises a pin and the second guiding element comprises a link, and that the pin is guided within the link during the transition from the first to the second operating state.

10. The device according to claim 1, wherein the holding element while holding the retraction element in the retaining position is arranged in a holding position, that in the receiving area an operating element is arranged, and that the operating element moves the holding element during the transition from the second to the first operating state from the holding position in a released position in which the holding element does not hold the retraction element in the retaining position.

11. The device according to claim 10, wherein the holding element is held by a spring in the holding position.

12. The device according to claim 1, wherein the cash box comprises a further elastic element which holds the retraction element in the swiveled-away position.

* * * * *